United States Patent [19]

Pierce

[11] Patent Number: 4,583,069

[45] Date of Patent: Apr. 15, 1986

[54] CRIMP FUSE LINK ASSEMBLY

[75] Inventor: Richard L. Pierce, St. Charles, Ill.

[73] Assignee: Molex Incorporated, Lisle, Ill.

[21] Appl. No.: 655,652

[22] Filed: Sep. 28, 1984

[51] Int. Cl.[4] ..... H01H 85/36; H01H 85/16

[52] U.S. Cl. ..... 337/240; 174/84 C; 337/234

[58] Field of Search ..... 337/240, 291, 239, 234, 337/231, 292; 174/84 C

[56] References Cited

U.S. PATENT DOCUMENTS 2,821,604 1/1958 Wallace ..... 337/291

3,354,282 11/1967 Batsch ..... 337/234

*Primary Examiner*—Harold Broome

*Attorney, Agent, or Firm*—Louis A. Hecht; Bruce R. Mansfield

[57] ABSTRACT

Disclosed is an improved fuse link assembly wherein a tensioned fusible element is secured at each end to a circuit conductor for connection to an external electrical circuit. The improvement includes an integral stamped crimp terminal which secures each end of the fusible element to a circuit conductor. The crimp member includes a serial succession of three discrete crimp portions, a first portion for receiving the fusible element, a second portion for receiving the circuit conductor, and a third portion for receiving a wire-like strain relief element disposed in parallel, cross the fusible element. The first crimp terminal (which receives the fusible element) is located between the second and third crimp portions. Each crimp portion has an internal diameter approximately equal to the diameter of the conductor received therein.

10 Claims, 2 Drawing Figures

CRIMP FUSE LINK ASSEMBLY

BACKGROUND OF THE INVENTION

1. Field of the Invention

The present invention is directed to electrical fuse link assemblies that are separated under tension, and in particular to such assemblies that have a strain relief member disposed in parallel with the fuse link.

2. Brief Description of the Prior Art

Such fuse link assemblies are usually operated at high voltages, typically 1 Kv and above. The tensioning of the fuse link provides current-clearing mechanical separation of the melted fuse link portions. It was discovered however, that if the fusible element is made to carry the tensile load, its designed fusing action would be altered. Strain relief members are, therefore, added in parallel to the fusible member to remedy this problem.

Because the strain relief members are made of conductive materials, it is convenient to form them from material having a much higher electrical resistance than the fusible member so as not to alter fuse operation. More importantly, this arrangement provides a dual action fuse operation, wherein a time delay fusing is provided for low energy, light overloads, while an instantaneous fusing is provided for higher energy, heavy overloads.

The present invention is directed to the securing of fusible and strain relief members in an operable fuse link assembly. Heretofore, this securement required a solder or other eutectic alloy connection to form a meltable weak spot. One example of such an arrangement is found in U.S. Pat. No. 2,859,307 issued to J. W. Enk on Nov. 4, 1958, which is directed to an improved, stronger soldered junction. In one embodiment, fusible conductor members are joined at their overlaping free ends in a junction block having a particular configuration. The junction block consists of two very large diameter cylindrical crimp tubes each of which receive a free end of a fusible conductor, and are thereafter deformed into a trough-like shaped having a cresent-like cross section. The two crimp tubes are arranged to overlie each other, with one crimp tube nested within the other, and are joined together by an intervening layer of solder. On a light overload, insufficient to fuse either conductor member, heat is transmitted to the intervening solder layer which would eventually melt, thereby providing a fusing action to break the overload current. As contemplated by the invention, the diameter of the crimp tube was many times larger than the diameter of the conductor received therein. This arrangement, according to the teaching of the patent, diffuses the heat generated in the fusible conductor ends so as to prevent localized erratic high temperature buildup in the solder. The crescent shaped crimp portions also provide an enhanced solder joinder between the crimp members, due to the complementary shape and nesting arrangement provided. In addition, the crescent shapes provide a more compact junction block which could fit within a smaller diameter outer insulating tube which surrounds the completed fuse link assembly.

SUMMARY OF THE INVENTION

As is emphasized in the aforementioned U.S. Pat. No. 2,859,307, difficulties in reliable precise fussing operation have plagued solder connections in fuse link assemblies. It is an object of the present invention to eliminate all such solder connections in a fuse link assembly, replacing such connections with a mechanical securement.

It is another object of the present invention to provide an improved securement of the respective ends of a plurality of elongated conductors in a single crimp member.

A related object of the present invention is to provide an unitary crimp member having a plurality of crimp sections arranged in a common plane, to provide a better resolution of tensile forces operating between the crimp member and the elongate conductors secured therein.

Yet another object of the present invention is to provide an unitary crimp member of simple inexpensive design, which affords an inexpensive crimping operation during fuse link assembly fabrication.

Still another object of the present invention to provide a unitary crimp member having a plurality of conventional crimp portions wherein the crimp portions have an internal diameter approximately equal to the diameter of the conductor received therein.

Another object of the present invention is to provide a crimp member which is economically formed by stamping a unitary planar conductive blank.

A further object of the present invention is to provide in a component fuse link assembly having coextensive fusible and strain relief members, and a crimp arrangement wherein the fusible member overlies the crimp portiion of the strain relief member, being secured adjacent thereto in an integral co-planar crimp member.

These and other objects of the present invention are provided in a fuse link assembly including a conductable fusible means having two ends, two circuit conductor means for connecting said fusible means to an external electrical circuit, and two terminal means each connecting a circuit conductor to a respective end of said fusible means, the improvement comprising:

two spaced-apart, integrally stamped conductive crimp members defining said two terminal means, each crimp member including a first crimp section for receiving an end of said fusible means such that said fusible means is mechanically and electrically connected between said crimp members and a second discrete crimp section for receiving one of the circuit conductor means.

BRIEF DESCRIPTION OF THE DRAWINGS

In the drawings, wherein like elements are referenced alike.

DETAILED DESCRIPTION OF THE PREFERRED EMBODIMENT

Figure 1:
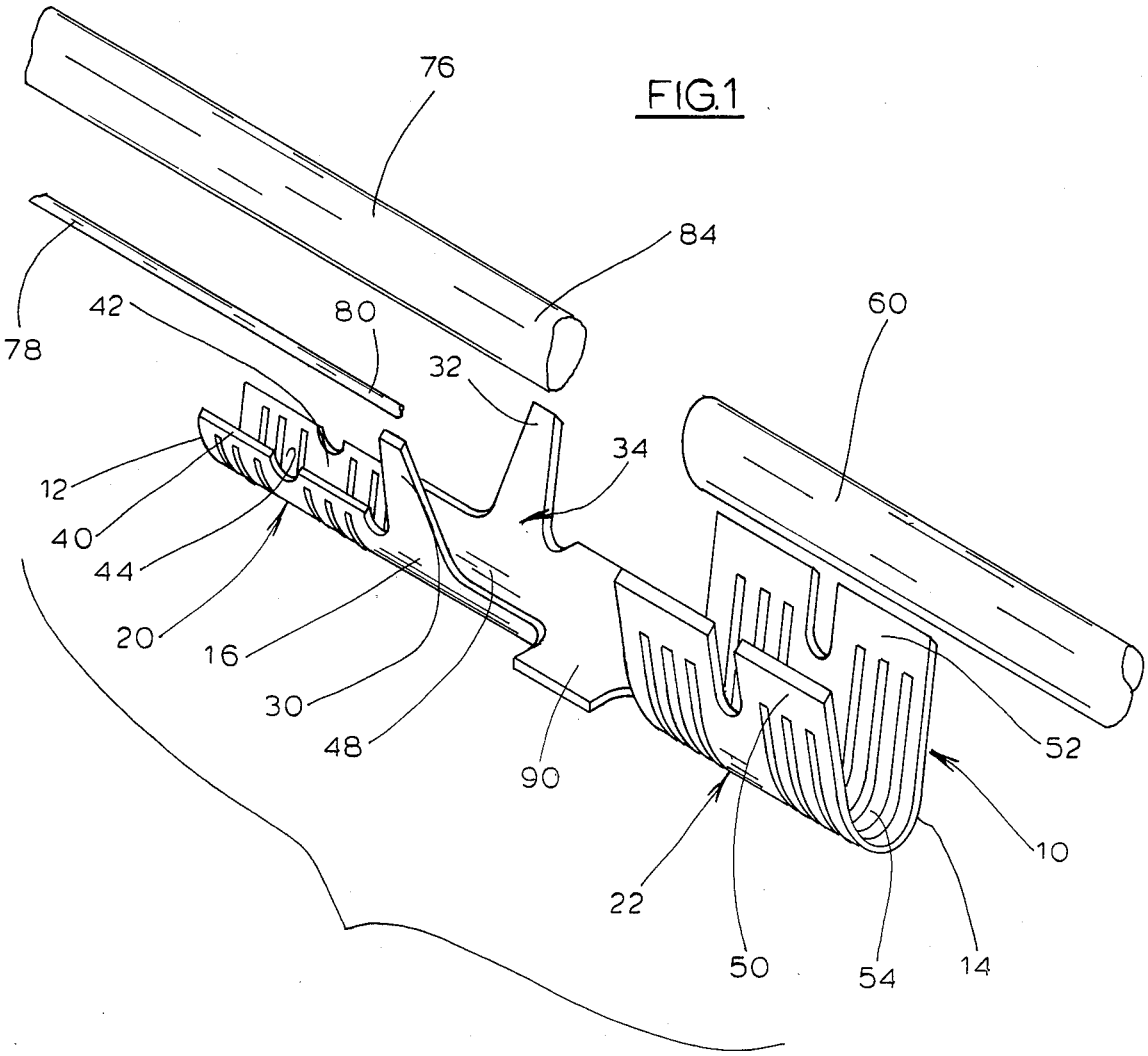
FIG. 1 is an exploded perspective view of a fuse link assembly according to the present invention, shown prior to assembly.

Referring now to the drawings, and especially to FIG. 1, terminal 10 is formed by stamping an integral conductive blank formed of copper, copper alloy or the like conductive material. Terminal 10 has first and second end portions 12, 14 and an intermediate portion 16. A trough-like crimp section 20 is formed adjacent end 12, and another trough-like crimp section 22 is formed adjacent the other end 14. Longitudinally offset crimping ears 30, 32 form a central, third crimp section 34. Crimp section 20 is comprised of upstanding side walls 40, 42 and an intermediate bight portion 44. Ears 30, 32 form upstanding side walls of crimp section 44 which are joined together by a bight portion 48. Similarily, crimp section 22 is comprised of upstanding side walls 50, 52 joined at a common bight portion 54. Bight portions 44, 48, and 54 lie on a common plane to afford an economical terminal formation, and also to provide improved retention in the various crimp sections which secure tensioned conductive members.

In use, a pair of terminals 10 is provided for the respective ends of each fuse link assembly. FIG. 1 shows the right hand terminal 10 of the assembly of FIG. 2 (the left hand terminal 10′ is physically identical thereto). End portions 14 are disposed immediately adjacent the remaining circuitry to which the fuse link assembly is connected. A circuit conductor is received within and retained by crimp section 22. As shown in FIG. 1 and the right hand portion of FIG. 2, circuit conductor 60 comprises a conventional braided cable or wire rope. Circuit conductor 60 could also comprise a cylindrical stud member or a bus bar if flexibility is not required.

Figure 2:
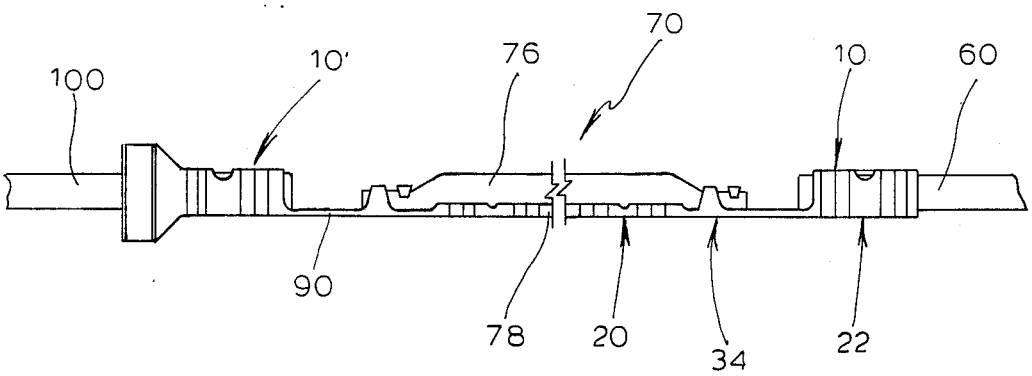
FIG. 2 is a partial elevation view of the fuse link assembly of FIG. 1, in fully assembled form.

As is shown in FIG. 2, terminals 10, 10′ are employed in a single fuse link assembly 70. Disposed between terminals 10, 10′ is a fusible conductor 76 comprised of tin, or the like conductive material having a desired fusing characteristic. Generally coextensive with fusible conductor 76, is a strain relief member 78, conventionally formed of a nickel-chromium alloy wire as is known in the art. Strain relief member 78 has a free end 80 which is received within and retained by crimp section 20. Fusible conductor 76 has a free end 84 which is received within and retained by crimp section 34. As can be seen in FIG. 2, fusible conductor 76 overlies the strain relief member 78 and is provided with an offset end portion 84 so as to make contact with bight portion 48 (which is co-planar with bight portion 44 retaining the strain relief element). This offset portion which is made equal to the diameter of strain relief member 78, allows fusible conductor 76 to be terminated in an integral crimp member at a position intermediate the terminal strain relief member 78 and the circuit conductor 60, thereby providing a straight line configuration which provides improved retention of those tensioned members.

The numeral 90 is directed to a carrier member which provides enhanced automatic fabrication of the fuse link assembly which is conveniently accomplished in two crimping operations. In the preferred embodiment, two identical terminals are positioned at either end of the strain relief wire. One terminal receives a flexible cable 60, and the other receives a stud member 100. The strain relief member 78 is then loaded into the terminals, and the four crimps are formed in a single first step. The carier member 90 is also trimmed in this step. Thereafter, the fusible element 76 is inserted in the terminals, and the remaining two crimp sections are formed. Thus a fuse link assembly can be fully assembled in a rapid two-step process, which consists only of conventional crimping and trimming operations.

As can be seen in the preferred embodiment of FIG. 2, the completed fuse link assembly 70 is attached at one end to a braided cable 60, and at the other end to a relatively inflexible stud member 100.

Thus, it can be seen that the present invention provides inexpensive automated assembly of a fuse link arrangement, which affords substantial cost savings to the fuse manufacturer.

I claim:

1. In a fuse link assembly including a conductable fusible means having two ends, two circuit conductor means for connecting said fusible means to an external electrical circuit, and two terminal means each connecting a circuit conductor to a respective end of said fusible means, the improvement wherein a tensioned force is applied to the fuse link assembly comprising:

two spaced-apart, integrally stamped conductive crimp members defining said two terminal means, said crimp members biased away from each other by the tension force;

an electrically conductive strain relief means connected between said crimp members to reduce tension on said fusible means; and each crimp member including a first crimp section for receiving an end of said fusible means such that said fusible means is mechanically and electrically connected between said crimp members, a second discrete crimp section for receiving one of the circuit conductor means, and a third discrete integrally formed crimp section for securing said strain relief means.

2. The arrangement of claim 1 wherein said first, second, and third crimp sections are aligned in a serial succession of stamped portions formed in a unitary blank.

3. The arrangement of claim 2 wherein said first, second, and third crimp sections each include co-planar bight portions.

4. The arrangement of claim 3 wherein said first crimp section is disposed between said second and said third crimp sections.

5. The arrangement of claim 4 wherein said strain relief means comprises an elongated conductor generally coextensive with and parallel to said fusible member and having a free end received in said third crimp section.

6. The arrangement of claim 5 wherein portions of the free end of said strain relief means is disposed between said fusible element and said bight of said third crimp section so as to be laterally adjacent thereto.

7. The arrangement of claim 6 wherein at least one of said circuit conductor means comprises a flexible conductive cable.

8. The arrangement of claim 7 wherein the other of said circuit conductor means comprises a relatively inflexible conductive stud member.

9. The arrangement of claim 5 wherein said strain relief means has a higher resistivity than said fusible member.

10. The arrangement of claim 1 wherein said two crimp members are substantially identical to each other and said fuse link assembly is fully assembled by crimping said six crimp sections.

* * * * *